United States Patent [19]

Dance

[11] Patent Number: 4,830,813

[45] Date of Patent: May 16, 1989

[54] LIGHTWEIGHT, LOW ENERGY NEUTRON RADIOGRAPHY INSPECTION DEVICE

[75] Inventor: William E. Dance, Dallas, Tex.

[73] Assignee: LTV Aerospace & Defense Company, Dallas, Tex.

[21] Appl. No.: 41,987

[22] Filed: Apr. 24, 1987

Related U.S. Application Data

[63] Continuation of Ser. No. 742,193, Jun. 7, 1985, abandoned, which is a continuation-in-part of Ser. No. 438,627, Nov. 2, 1982, abandoned.

[51] Int. Cl.[4] ..... G21K 5/00

[52] U.S. Cl. ..... 376/110; 376/114

[58] Field of Search ..... 376/110, 109, 114, 115, 376/151

[56] References Cited

U.S. PATENT DOCUMENTS

| | | | |
|---|---|---|---|
| 2,816,242 | 12/1957 | Goodman | 376/151 |
| 2,964,634 | 12/1960 | Harris | 376/114 |
| 3,016,461 | 1/1962 | Reiffel | 376/114 |
| 3,113,213 | 12/1963 | Brinkerhoff et al. | 376/114 |
| 3,151,243 | 9/1964 | Mott | 376/114 |
| 3,417,245 | 12/1968 | Schmidt | 376/115 |
| 4,076,990 | 2/1978 | Hendry et al. | 376/115 |
| 4,300,054 | 11/1981 | Dance et al. | 376/110 |

FOREIGN PATENT DOCUMENTS

| | | | |
|---|---|---|---|
| 1217515 | 12/1970 | United Kingdom | 376/110 |

OTHER PUBLICATIONS

Materials Evaluation, vol. 29, No. 4, 4/71, pp. 69–74, Wilson et al.

Nuclear Instruments & Methods, vol. 92, No. 4, 1971, pp. 613–617, Spowart.

Nuclear Technology, vol. 14, 6/72, pp. 279–283, Vasilik et al.

*Primary Examiner*—Harvey E. Behrend

*Attorney, Agent, or Firm*—J. M. Cate; S. S. Sadacca

[57] ABSTRACT

A lightweight, low energy neutron radiography inspection device (20) includes an inspection head (22) with a sealed tube neutron generator (44) using a deuterium target (110) for emitting relatively low energy neutrons. A moderating fluid (140) within the head is used to thermalize the neutrons emitted from the neutron source. A collimator (40) directs the thermalized neutrons to produce a thermal neutron radiograph. The relatively low energy neutrons produced by the neutron generator permit the reduction in volume of moderating fluid required and thus the use of a smaller, more maneuverable, inspection head.

11 Claims, 1 Drawing Sheet

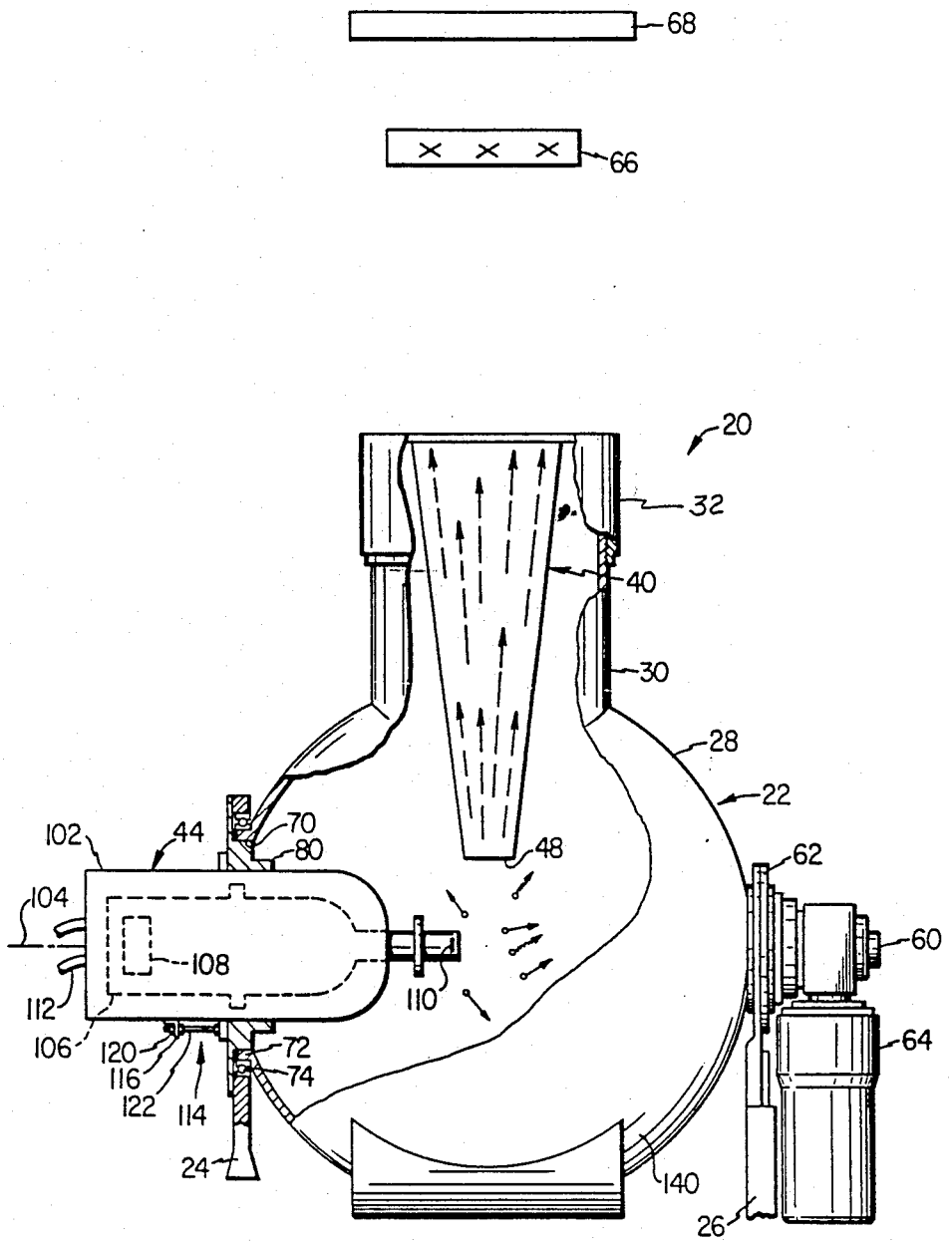
68
66
20
32
40
30
28
22
62
60
64
140
26
102
44
70
80
48
104
108
110
112
106
120
116
122
114
72
74
24

LIGHTWEIGHT, LOW ENERGY NEUTRON RADIOGRAPHY INSPECTION DEVICE

CROSS REFERENCE TO RELATED APPLICATION

This is a continuation of application Ser. No. 742,193, filed June 7, 1985 now abandoned, which is a continuation in-part of application Ser. No. 438,627 filed Nov. 2, 1982, now abandoned.

TECHNICAL FIELD

This invention relates to neutron radiography and more particularly to a lightweight, low energy neutron radiography inspection head for mobile radiography devices.

BACKGROUND ART

Prior neutron radiography inspection devices, such as that disclosed in U.S. Pat. No. 4,300,054, to the inventor of the present invention, incorporate as the radiation source an ion accelerator neutron generator which generates 14 MeV neutrons. This neutron generator is a high-flux sealed-tube unit which derives neutrons from the reaction which occurs when a tritium target is bombarded by a beam of deuterium ions. This reaction is denoted by $^3H(d, n)^4He$, and is commonly abbreviated "D-T".

The radiation source is housed in an essentially spherical inspection head containing a hydrogen-rich liquid moderator. The head contains a collimator mounted with one end within the liquid moderator. The 14 MeV neutrons, designated as fast neutrons, produced in the tritium target, are moderated or thermalized by the liquid moderator surrounding the source. These thermalized neutrons are then directed by the collimator to the structure which is to be inspected. The inspection head is maneuverable on support arms such that difficult-to-reach structures and assemblies may be examined in the field or during manufacture.

The minimum size and weight of the inspection head are dictated primarily by the energy of the source neutrons and the volume of moderator material required to reduce the energy of the neutrons to thermal levels, measured at the input of the beam collimator, necessary for thermal neutron radiography. The thermal level is approximately 0.025 eV. Additional moderator volume greater than that required for effective thermalization of the fast neutron beam from the source serves to reduce radiation levels around the device, and hence reduces the shielding and/or the distance an operator or other personnel must stand away from the device during operation. However, the addition of moderator material beyond the minimum required for effective thermalization rapidly increases the weight of the inspection head and decreases its practical maneuverability. Thus, in the design of a system using an accelerator source of 14-MeV neutrons, the requirement for moderator material and shielding determines the physical size of the inspection head and thus controls the maneuverability of the device.

Although the prior art device identified above provides a maneuverable neutron radiography inspection device, the ability to reduce the size of the inspection head even further would increase maneuverability and make the unit useable in more situations, for example, those requiring extended reach, than is presently possible.

SUMMARY OF THE INVENTION

The present invention relates to a lightweight, relatively low energy neutron radiography inspection head for mobile radiography devices. The inspection head includes a sealed tube neutron generator using a deuterium target for emitting relatively low energy neutrons. A moderating fluid within the head is used to thermalize the neutrons emitted from the neutron source. A collimator directs the thermalized neutrons to produce a thermal neutron radiograph.

In accordance with one embodiment of the invention, the neutron generator produces low energy neutrons having an energy level of approximately 3 MeV. Because the present invention incorporates the use of a sealed tube neutron generator which produces relatively low energy neutrons, the volume of moderator material required to reduce the energy of the neutrons to thermal levels, approximately 0.025 eV, at the output of the beam collimator, is reduced. Thus, the size of the inspection head may be greatly reduced over prior art devices. With a substantially reduced inspection head size, the present invention provides for a far more maneuverable unit which may be used to inspect components in assembled structures or during manufacture where great versatility in positioning and extended reach of the head is required.

In accordance with the method of the present invention for producing a thermal neutron radiograph, the invention comprises generating a relatively low-energy neutron beam in a neutron generator using a deuterium target. The beam is moderated to a predetermined thermal level and directed by a collimator to produce a thermal neutron radiograph. In a preferred embodiment of the invention, the low energy neutrons have an energy of approximately 3 MeV and the neutrons are moderated to 0.025 eV. Moderating of the beam is by directing the neutron beam into an inspection head having moderating fluid therein for thermalizing the neutrons. The neutron beam is directed by a collimator toward the structure to be inspected.

Thus, the present invention provides a neutron radiography system which uses an inspection head incorporating a neutron generator for producing neutrons with a relatively low energy level, on the order of 3 MeV. Neutron generation is by use of a deuterium rather than a tritium target in an ion accelerator neutron generator. Use of relatively low energy neutrons reduces the required moderating fluid and thus reduces the required size of the inspection head. By providing a small inspection head, more versatility is achieved.

BRIEF DESCRIPTION OF THE DRAWING

For a more complete understanding of the present invention, and for further details and advantages thereof, reference is now made to the following Detailed Description taken in conjunction with the accompanying Drawing, in which:

The DRAWING FIGURE is a partially broken away plan view of the neutron radiography inspection devic of the present invention.

DETAILED DESCRIPTION

Referring to the DRAWING FIGURE, neutron radiography inspection device 20 is illustrated in a partial broken away plan view. Inspection device 20 includes an inspection head 22 pivotally supported from support arms 24 and 26. Head 22 includes a spherical main body 28 with a sealed tube neutron generator 44 mounted relative to the body as will be described hereinafter in greater detail. A cylindrical collimator support housing 30 extends from main body 28. A cap 32 is threadedly engaged on the end of collimator support housing 30. A collimator 40 is attached to cap 32 at the uppermost end as seen in the FIGURE. The collimator is provided with a relatively narrow neutron permeable input window 48 for admitting neutrons diverging through the input aperture and traveling generally parallel to the axis of the tube of the collimator. The walls of the collimator are formed of an appropriate material to absorb off-axis thermal neutrons. Inspection head 22 is supported on one side by arm 26 by the journaling of a shaft 60 extending from head 22 through an appropriate bearing structure 62. A drive motor 64 is also mounted for turning shaft 60 to rotate inspection head 22. The FIGURE illustrates head 22 positioned with collimator 40 directed toward a specimen 66 which is to be examined with a film 68, or other imaging device including real time imaging positioned therebehind.

An opening 70 is provided in head 22 and is coaxially aligned with shaft 60 in the opposite side of the housing from shaft 60. Opening 70 is provided with an axially extending flange 72 which is supported by bearing 74 carried in support arm 24. Accordingly, upon actuation of drive motor 64, head 22 is rotated about its horizontal axis on support bearing 74 and bearing structure 62.

A relatively large opening is defined by flange 72 concentric with the rotational axis of the housing. An annular flange hub 80 is attached to support arms 24 by appropriate bolts and is fitted within the opening defined by flange 72. Sealing means, such as O-rings, are carried in appropriate grooves in the inner face of the radially extending flange 72 to provide sealing engagement between flange 72 and flange hub 80. Neutron generator 44 has an elonated housing 102 and is mounted with its longitudinal axis 104 coincident with the axis of rotation of inspection head 22. Housing 102 contains an elongated evacuation tube 106 having a positive ion source 108 near one end thereof and an appropriate target 110 at the opposite end. In the present invention, the target 110 is deuterium. Upon bombardment by ions generated in tube 106, deuterium target 110 emits relatively low energy neutrons. In one embodiment of the invention, the low energy neutrons have an energy level of approximately 3 MeV.

Of the various types ofnneutron sources which could be employed, an on/off switchable ion source is used because of the hazards of conventional continuous radioisotopic sources. To provide a sufficient flux at the imaging plane of the collimator to achieve reasonable exposure times, a thermal neutron flux of at least 0.5 to $1\times10^5$ n/cm$^2$-second is preferred. A high-intensity tube is required to achieve this preferred neutron flux where a deuterium target is used. Such a neutron generator may be fashioned by modifying a high intensity tube of the type offered by Philips Electronic Components and Material Division, Eindhoven, the Netherlands. The high intensity therapy system provided by Philips is a sealed-off D-T neutron tube of the on/off type, having a yield of $10^{12}$ n/s. In the present invention, a deuterium target, rather than a tritium target, is used to provide an expected yield in the range of 1 to $5\times10^{10}$ D-D, n/s and a neutron flux at the imaging plane of the collimator in the range of 0.5 to $1\times10^5$ n/cm.$^2$-second. An acceleration voltage of 250 kV and 20 mA of beam current is used. This neutron generator, as modified according to the present invention, produces relatively low energy neutrons, on the order of 3 MeV, by the bombardment of a deuterium target by a deuterium beam. This reaction is denoted by $^2H(d,n)^3He$ and is abbreviated "D-D".

Other neutron generators of the on/off type may be modified to practice the present invention. For example, neutron generator model A-711, manufactured by Kaman Sciences Corporation, Colorado Springs, Colo., may be used in the practice of the present invention. The A-711 generator uses a tritium target to produce D-T, 14 MeV neutrons. In the practice of the present invention, a deuterium target is substituted for the tritium target to likewise produce relatively low energy neutrons, on the order of 3 MeV, by virtue of the D-D reaction. However, the model A-711 is a lower intensity generator and thus would have a yield in the range of 0.5 to $1\times10^9$ n/s thereby requiring a longer exposure time than if a high intensity tube is used. A range of 1 to $5\times10^{10}$ D-D n/s, or greater, is the preferred range for purposes of neutron radiography.

The neutron generator used in the present invention comprises an elongated cylindrical housing with a deuterium target at one end and a plurality of high voltage inputs 112 at the opposite end. Voltage can thereby be selectively applied to the accelerator tube to generate 3 MeV neutrons when desired. As mentioned above, in a preferred embodiment an acceleration voltage of 250 kV and 20 mA of beam current is used.

Referring to the FIGURE, neutron generator 44 may be moved along its longitudinal axis 104 by the adjustment structure 114 provided. The adjustment structure includes an angle fitting 116 attached to the outer wall of neutron generator housing 102. An appropriate bolt has one end engaged within flange hub 80 and the opposite end passing through an aperture in the out-turned leg of angle fitting 116. Nut 120 is engaged on the threaded end of shaft 122 and by adjusting the nut, the neutron generator may be moved inwardly or outwardly along its longitudinal axis. An appropriate seal is positioned circumferentially around neutron generator housing 102 and adjacent flange hub 80. The seal acts to provide a fluid-tight seal between flange hub 80 and neutron generator housing 102.

The neutrons emitted by deuterium target 110 are not suitable for thermal neutron radiography, but must be moderated to provide low energy thermal neutrons, having thermal levels of approximately 0.025 eV. Moderation of the neutrons is accomplished by submerging the target 110 in a moderator fluid such as water or a suitable organic fluid such as high purity transformer oil. Accordingly, inspection head 22 is filled with a suitable moderator fluid 140. The high energy neutrons emitted by the target collide with the hydrogen protons in the moderator fluid giving up energy to the fluid as they diffuse therethrough.

The radius of the spherical body 28 is determined by the energy of the fast neutrons emitted in the moderator fluid so that the neutrons emitted from the target will be effectively moderated or thermalized by multiple collisions by the time they diffuse to inlet window 48 of collimator 40. Because the energy reduction of the neutrons is substantially less than is required in prior art devices using fast neutrons having an energy of 14 MeV, the moderator volume is significantly reduced, permitting the use of a smaller inspection head.

Although the fast neutron yield or beam intensity from the D-D reaction is significantly lower than that for the 14 MeV tube of a given power, the efficiency of a given moderator for thermalizing the 3 MeV neutrons is greater because of the lower energy level of the neutrons.

A weight savings in the inspection head of approximately 50% or more is possible by using 3 MeV neutrons. This in turn makes possible the use of a lighter weight boom for supporting the inspection head with potential for greater reach of the inspection head for inspecting various structures. Although this advantage carries the additional requirement for a larger power supply and cooling system to drive the neutron generator for a given flux of thermal neutrons, this power supply and cooling system will be ground based and thus does not interfere with the primary advantages provided, that is, the ability to use a smaller inspection head which will be more maneuverable and extendable than the prior art devices.

A further advantage found in the present invention results from the fact that 3 MeV neutrons have a lower scattering cross section than 14 MeV neutrons. As a result, fewer neutrons are reflected into the image plane from adjacent structures and materials, and thus a superior radiograph is produced.

Thus, the present invention provides a neutron radiography device using a neutron source which produces relatively low energy neutrons. In turn, such neutrons rqquire a smaller quantity of moderator and/or less shielding when compared with the prior art devices using higher energy neutrons. Because the moderation fluid and the primary shielding is in the inspection head, the present invention provides for a more compact inspection head. Because the head weight is a cubic function of the radius, a small reduction in the radius substantially reduces the head weight.

Although preferred embodiments of the invention have been described in the foregoing Detailed Description and illustrated in the accompanying Drawing, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A device for conducting neutron radiography comprising:

an on/off sealed tube neutron generator using solely a deuterium target for emitting relatively low energy neutrons having an energy level of approximately 3 MeV and an unthermalized neutron yield of at least approximately $1\times10^{10}$ D-D n/second, a maneuverable inspection head supporting said neutron generator and having moderating fluid therein to thermalize the neutrons emitted from the neutron source, and collimator means for directing said thermalized neutrons to an imaging plane to produce a thermal neutron radiograph.

2. The neutron radiography device according to claim 1 wherein said neutron generator produces low energy neutrons having an energy level of approximately 3 MeV.

3. The neutron radiography device according to claim 1 wherein said neutron generator produces a thermal neutron flux availabe at the imaging plane of the collimator of at least approximately $0.5\times10^5$ n/cm$^2$-second.

4. A radiography device comprising:

a high intensity neutron generator for generating an unthermalized neutron yield of at least approximately $1\times10^{10}$ D-D n/second by the bombardment of a target comprised solely of deuterium by a beam of deuterium ions, said neutrons having an energy level of approximately 3 MeV, a maneurvering inspection head supporting said neutron generator and having moderating fluid therein to thermalize the neutrons emitted from the neutron generator, and means for directing said thermalized neutrons to produce a thermal neutron radiograph.

5. The neutron radiography device according to claim 4 wherein said neutron generator produces a thermal neutron flux available at the imaging plane of the collimator of at least approximately $0.5\times10^5$ n/cm$^2$-second.

6. The neutron radiography device according to claim 4 wherein said neutron generator produces a thermal neutron flux available at the imaging plane of the collimator of at least approximately $0.5\times10^5$ n/cm$^2$-second.

7. A method of neutron generation for use in neutron radiography comprising:

using a high intensity neutron generator to generate an unthermalized neutron beam having a yield of at least approximately $1\times10^{10}$ D-D n/second and having energy on the order of 3 MeV by bombardment of a target comprised solely of deuterium ions, moderating said beam to a predetermined thermal level, and directing said beam to produce a thermal neutron radiograph.

8. The method according to claim 7 wherein said low energy neutron beam is moderated to 0.025 eV.

9. The method according to claim 7 wherein said moderating of said beam is by directing said neutron beam into an inspection head having moderating fluid therein whereby said neutrons are moderated to a predetermined energy level.

10. The method according to claim 9 wherein directing said beam comprises positioning a collimator with one end in the inspection head to receive the moderated neutrons and direct said neutrons for producing a radiograph.

11. The method according to claim 7 wherein said moderated beam provides a thermal neutron flux of at least approximately $0.5\times10^5$ n/cm$^2$-second.

* * * * *